US012371206B2

(12) United States Patent
Ponti

(10) Patent No.: US 12,371,206 B2
(45) Date of Patent: Jul. 29, 2025

(54) METHOD FOR REALISING A BLANK FOR BOXING ONE OR MORE ARTICLES FROM A CARDBOARD SHEET FOR PACKAGING, AND A RELATIVE MACHINE

(71) Applicant: C.M.C. S.p.A., Cerbara (IT)

(72) Inventor: Lorenzo Ponti, Citta' di Castello (IT)

(73) Assignee: C.M.C. S.p.A. (IT)

( * ) Notice: Subject to any disclaimer, the term of this patent is extended or adjusted under 35 U.S.C. 154(b) by 0 days.

(21) Appl. No.: 18/579,611

(22) PCT Filed: Jul. 20, 2022

(86) PCT No.: PCT/IB2022/056684
§ 371 (c)(1),
(2) Date: Jan. 16, 2024

(87) PCT Pub. No.: WO2023/002394
PCT Pub. Date: Jan. 26, 2023

(65) Prior Publication Data

US 2024/0317434 A1 Sep. 26, 2024

(30) Foreign Application Priority Data

Jul. 22, 2021 (IT) ..... 102021000019469

(51) Int. Cl.
*B65B 5/02* (2006.01)
*B65B 59/00* (2006.01)
(Continued)

(52) U.S. Cl.
CPC ..... *B65B 5/02* (2013.01); *B65B 59/001* (2019.05); *B65B 59/02* (2013.01); *B65B 61/005* (2013.01); *B65B 61/02* (2013.01); *B65B 2210/04* (2013.01)

(58) Field of Classification Search
CPC ... B31B 2120/502; B31B 50/20; B31B 50/25; B65B 2210/04; B65B 41/10;
(Continued)

(56) References Cited

U.S. PATENT DOCUMENTS 4,822,325 A 4/1989 Vossen
7,587,884 B2 9/2009 Durand et al.
(Continued)

FOREIGN PATENT DOCUMENTS

EP 2861389 B1 3/2017
IT 201700066129 A1 12/2018
(Continued)

OTHER PUBLICATIONS

Machine translation of Ponti to IT201900004986A (Year: 2020).*

*Primary Examiner* — Anna K Kinsaul
*Assistant Examiner* — Himchan Song
(74) *Attorney, Agent, or Firm* — Endurance Law Group PLC

(57) ABSTRACT

A method for realising a cardboard blank for boxing articles comprising: arranging a first support having first and second scoring tools; a second support having third and fourth scoring tools; detecting and memorising the dimensions of articles; adjusting the distance between the first and the second scoring tool so the first and score lines are parallel to the advancement direction (D); moving the first support (5) so that third and fourth score lines are oblique to the advancement direction (D); moving the first and second scoring tools so they realise a fifth score line (18) which is transversal to the advancement direction (D); moving the second support so that sixth and seventh score lines are oblique to the advancement direction (D); moving the third and the fourth scoring tool so they realise an eighth score line which is transversal to the advancement direction (D).

10 Claims, 10 Drawing Sheets

(51) Int. Cl.
*B65B 59/02* (2006.01)
*B65B 61/00* (2006.01)
*B65B 61/02* (2006.01)

(58) Field of Classification Search
CPC ..... B65B 43/10; B65B 43/24; B65B 43/265; B65B 5/02; B65B 57/12; B65B 59/001; B65B 59/003; B65B 59/02; B65B 61/005; B65B 61/02
See application file for complete search history.

(56) References Cited

U.S. PATENT DOCUMENTS

| | | | | |
|---|---|---|---|---|
| 2013/0000252 | A1* | 1/2013 | Pettersson | B65B 5/024 348/46 |
| 2015/0360433 | A1* | 12/2015 | Feijen | B31B 50/74 493/162 |
| 2015/0360801 | A1* | 12/2015 | Sytema | B65B 49/16 53/74 |
| 2016/0185065 | A1* | 6/2016 | Sytema | B65B 5/024 493/183 |
| 2016/0185475 | A1* | 6/2016 | Pettersson | B65B 43/08 53/493 |
| 2017/0320614 | A1* | 11/2017 | Govers | B65D 5/6664 |
| 2019/0300210 | A1* | 10/2019 | Ponti | B65D 5/20 |

FOREIGN PATENT DOCUMENTS

| | | | | |
|---|---|---|---|---|
| IT | 201900004986 | A | * | 10/2020 |
| WO | 2013190424 | A1 | | 12/2013 |
| WO | 2020202015 | A1 | | 10/2020 |

* cited by examiner

METHOD FOR REALISING A BLANK FOR BOXING ONE OR MORE ARTICLES FROM A CARDBOARD SHEET FOR PACKAGING, AND A RELATIVE MACHINE

FIELD OF THE INVENTION

The present invention relates to the technical sector concerning the realisation of a blank for obtaining a cardboard box with which to box one or more articles.

In particular the invention relates to a method for realising a blank for boxing one or more articles from a cardboard sheet for packaging, and a relative machine for actuating the method.

DESCRIPTION OF THE PRIOR ART

A cardboard sheet for packaging can be used for various purposes, for example for forming a cardboard box.

In this case, it is necessary to first make fold lines, also known as score lines, which divide the cardboard sheet for packaging into numerous portions in such a way as to obtain a blank and, in a like way, cut lines.

The various portions of the blank can thus be easily folded about the score lines, obtaining a cardboard box for boxing one or more articles in a simple and rapid way, avoiding the formation of deformations and cracks in the cardboard sheet for packaging during the steps of folding.

To date, a known a method for realising a blank for boxing one or more articles from a cardboard sheet for packaging includes the use of, for the making of the score lines and cut lines, scoring tools or cutting tools of mechanical type, such as scoring cutters, blades or knives.

In a case where a cardboard sheet is fed in that has predetermined dimensions, the same for each work cycle, the tools can be positioned and configured to carry out always a same displacement path, as they are adjusted to carry out a predetermined activity on the cardboard sheet.

This aspect constitutes a limit, as, in entry to the machine carrying out the steps for realising a blank, for each work cycle cardboard sheets al having the same dimensions will have to be fed in, since otherwise the realising of the score lines or the cut lines might be done wrongly and with imprecision, i.e. not in the requested positions.

Further, again in a case where a cardboard sheet is fed in that has predetermined dimensions, or in a case in which a cardboard sheet is fed in that has different dimensions from the preceding, it might become necessary to make score lines in different points in one blank and a next blank, and, therefore, the tools will make score lines or cut lines in different positions as a function of the dimensions of the one or more articles to be boxed.

In this case, it will be necessary to demount the mechanical scoring tools and cutting tool, to reposition them and reconfigure them according to the dimensions of the one or more articles to be boxed.

In the most extreme cases, i.e. in a case in which it is impossible to reposition and reconfigure the mechanical cutting tools, recourse could be made to the use of a different machine, so as to be able to correctly make the score lines (i.e. in the requested positions).

Alternatively to the foregoing, the score lines or cut lines present on the blank can be made using a laser beam and: therefore, with scoring means of a laser-type.

However, though the scoring means of the laser type enable easy management of a size change since they are configured to be orientated as a function of the dimensions of one or more articles to be boxed and as a function of the cardboard sheet, the fact that they are of the laser type makes the scoring means particularly expensive resulting in an increase in production costs of the blank to be realised.

SUMMARY OF THE INVENTION in the light of the above, the aim of the present invention consists in obviating the above-mentioned drawbacks of the prior art.

The above aims are attained by a method for realising a blank for boxing one or more articles from a cardboard sheet for packaging according to claim and by a machine for actuating the method for realising a blank for boxing one or more articles from a cardboard sheet for packaging according to claim 6.

Advantageously, the scoring means, comprising a first support which bears a first scoring tool and a second scoring tool and a second support which bears a third scoring tool and a fourth scoring tool, are moved along a first direction and second direction, parallel to the advancement direction, together with the movement, respectively, of the first scoring tool and the second scoring tool along the first support and of the third scoring tool and of the fourth scoring tool along the second support, enabling the realising of the score lines on the blank as a function of the dimensions detected and memorised of the one or more articles to be boxed.

Therefore it will be easily possible to feed cardboard sheets of different dimensions, as the realising of the score lines and, therefore, the movement of the scoring means, takes place as a function of the dimensions of one or more articles to be boxed.

The method and the machine that are the object of the present invention enable the realising of the score lines with lower costs with respect to the method and machine of known type, which use laser-type scoring means, while guaranteeing the same results obtained using those means.

BRIEF DESCRIPTION OF THE DRAWINGS

Specific embodiments of the invention will be described in the following part of the present description, according to what is set down in the claims and with the aid of the accompanying tables of drawings, in which:

DESCRIPTION OF THE PREFERRED EMBODIMENTS

Figure 1:
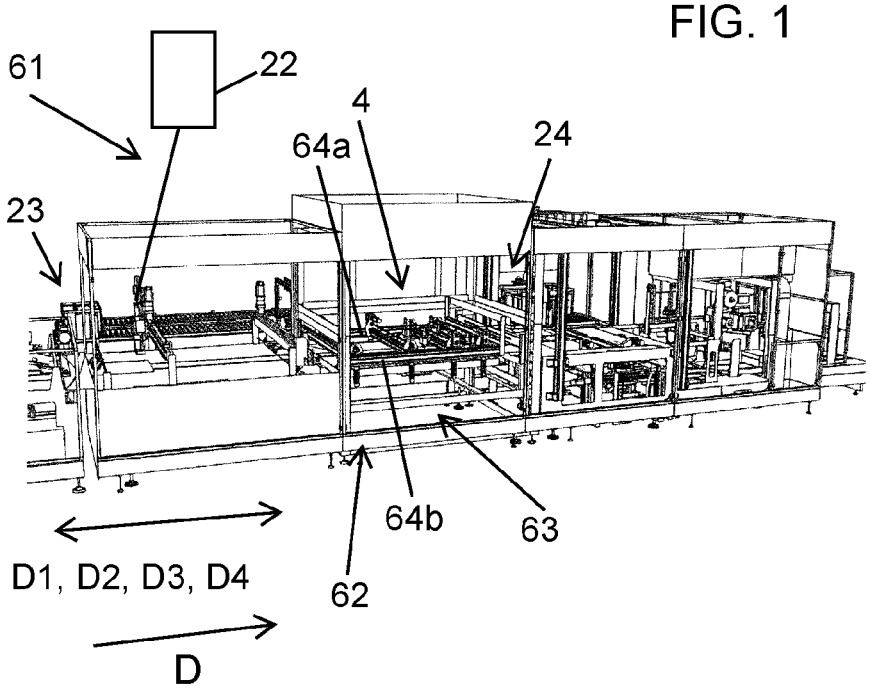
FIG. 1 is a perspective view of the machine of the present invention.

With reference to the appended tables of drawings, reference numeral (1) denotes in its entirety a blank for boxing one or more articles (3) from a cardboard sheet (2) for packaging.

In the following a method is described for realising a blank (1) for boxing one or more articles (3) from a cardboard sheet (2) for packaging, object of the present invention, comprising steps of:

arranging a conveyor (23) for feeding a cardboard sheet (2) for packaging according to an advancement direction (D);

arranging detecting means (24) for detecting dimensions of one or more articles (3) to be boxed;

arranging scoring means (4) comprising:

a first support (5) which is arranged transversally to the advancement direction (D) and which is movable along a first direction (D1) parallel to the advancement direction (D) and which bears a first scoring tool (6) and a second scoring tool (7), which are movable, mutually towards and away from one another, along the first support (5);

a second support (8) which is arranged transversally to the advancement direction (D) and which is movable along a second direction (02) parallel to the advancement direction (D) and which bears a third scoring tool (9) and a fourth scoring tool (10), which are movable, mutually towards and away from one another, along the second support (8);

detecting and memorising, using detecting means (24), the dimensions of one or more articles (3) to be boxed.

On the basis of the dimensional values detected and memorised, the method further comprises steps of;

adjusting the distance, along the first support (5), between the first scoring tool (6) and the second scoring tool (7) so that, during the advancement of the cardboard sheet (2) along the advancement direction (D), the first scoring tool (6) realises a first score line (11) parallel to the advancement direction (D) and the second scoring tool (7) realises a second score line (12) which is parallel to the first score line (11), so as to define, on the cardboard sheet (2);

a central sector (13) comprised between the first score line (11) and the second score line (12); a first lateral sector (14) comprised between the first score line (11) and a first lateral edge (2*a*) of the cardboard sheet (2), which first lateral edge (2*a*) is parallel to the advancement direction (D); a second lateral sector (15) comprised between the second score line (12) and a second lateral edge (2*b*) of the cardboard sheet (2), which second lateral edge (2*b*) is parallel to the first lateral edge (2*a*);

moving the first support (5), relative to the cardboard sheet (2), along the first direction (D1) and, contemporaneously, moving the first scoring tool (6) and the second scoring tool (7) along the first support (5) so that: the first scoring tool (6) realises, in the first lateral sector (14), a third score line (16) between the first lateral edge (2*a*) of the cardboard sheet (2) and the first score line (11), which third score line (16) is oblique with respect to the advancement direction (D) and intersects the first score line (11) in first intersection point (P1); the second scoring tool (7) realises, in the second lateral sector (15), a fourth score line (17) between the second lateral edge (2*b*) of the cardboard sheet (2) and the second score line (12), which fourth score line (17) is oblique with respect to the advancement direction (D) and intersects the second score line (12) in a second intersection point (P2);

moving the first scoring tool (6) and the second scoring tool (7) along the first support (5) so that the first scoring tool (6) and the second scoring tool (7) realise a fifth score line (18) which is transversal to the advancement direction (D) and which extends between the first lateral edge (2*a*) of the cardboard sheet (2) and the second lateral edge (2*b*) of the cardboard sheet (2) and which intersects the first score line (11) at the first intersection point (P1) and the second score line (12) at the second intersection point (P2) (see FIGS. 6-9).

The method further comprises steps of:

moving the second support (8), relative to the cardboard sheet (2), along the second direction (D2) and, contemporaneously, moving the third scoring tool (9) and the fourth scoring tool (10) along the second support (8) so that: the third scoring tool (9) realises, in the first lateral sector (14), a sixth score line (19) between the first lateral edge (2*a*) of the cardboard sheet (2) and the first score line (11), which sixth score line (19) is oblique with respect to the advancement direction (D) and intersects the first score line (11) in a third intersection point (P3); the fourth scoring tool (10) realises, in the second lateral sector (15), a seventh score line (20) between the second lateral edge (2*b*) of the cardboard sheet (2) and the second score line (12), which seventh score line (20) is oblique with respect to the advancement direction (D) and intersects the second score line (12) in a fourth intersection point (P4);

moving the third scoring tool (9) and the fourth scoring tool (10) along the second support (8) so that the third scoring tool (9) and the fourth scoring tool (10) realise an eighth score line (21) which is transversal to the advancement direction (D) and which extends between the first lateral edge (2*a*) of the cardboard sheet (2) and the second lateral edge (2*b*) of the cardboard sheet (2) and which intersects the first score line (11) at the third intersection point (P3) and the second score line (12) at the fourth intersection point (P4) (see FIGS. 5-10).

The first score line (11) can be parallel to the first direction (D1) and to the second direction (D2) (see FIGS. 6-9).

In the same way, the second score line (12) can be parallel to the first direction (D1) and to the second direction (D2) (see FIGS. 6-9).

Figure 10:
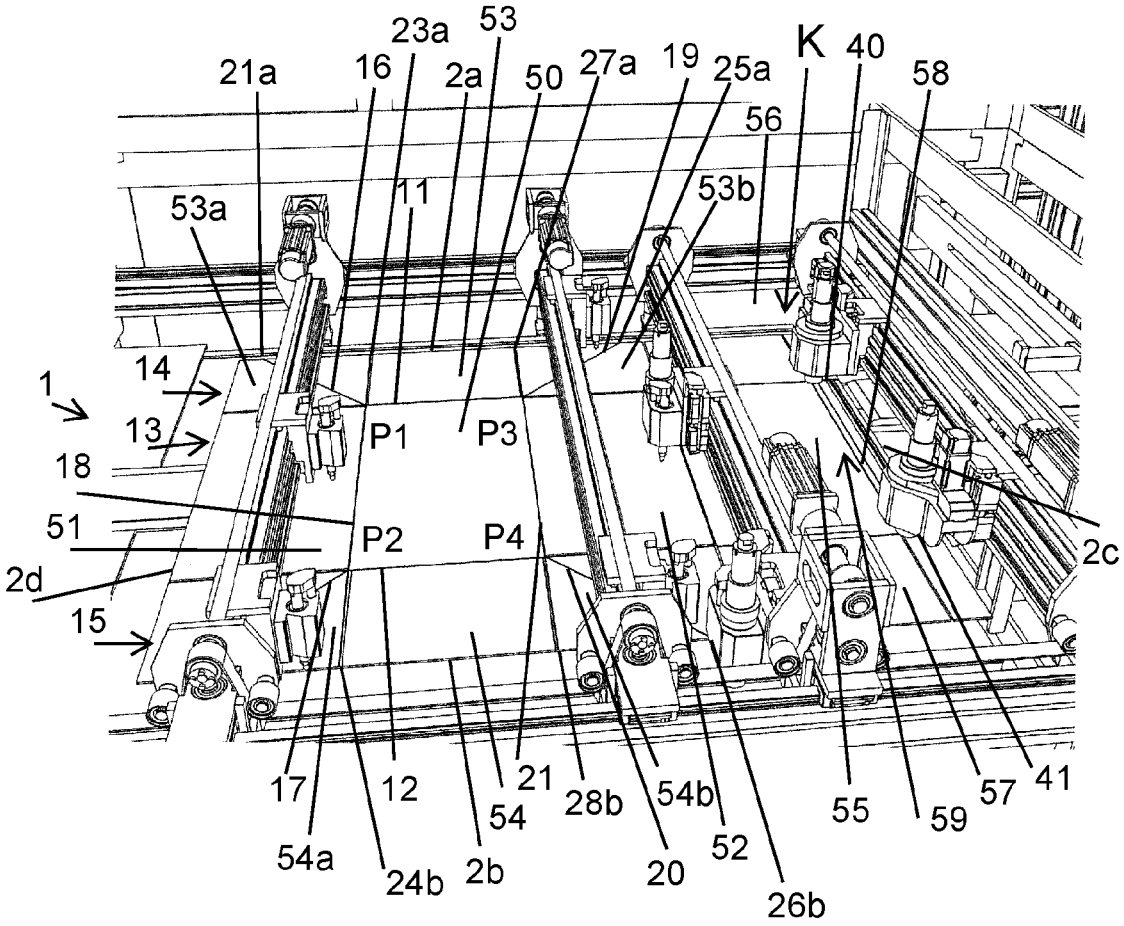

The blank (1), realised by carrying out the steps of the method as described in the foregoing, can comprise:

in the central sector (13);

a main portion (50), which is comprised between the fifth score line (18) and the eighth score line (21) and which has dimensions such as to cover the bottom of the one or more articles (3) to be boxed: a first lateral portion (51) and a second lateral portion (52), on opposite sides of the main portion (50) with respect to the fifth score line (18) and to the eighth score line (21);

in the first lateral sector (14):

a third lateral portion (53), which is comprised between the fifth score line (18), the eighth score line (21), the first lateral edge (2*a*) of the cardboard sheet (2) and the first score line (11); a first reinforcing portion (53*a*) and a second reinforcing portion (53*b*), on opposite sides of the third lateral portion (53), with respect to the fifth score line (18) and to the eighth score line (21), with the third and the sixth score line (16, 19) being realised, respectively, in the first reinforcing portion (53*a*) and in the second reinforcing portion (53*b*);

in the second lateral sector (15):

a fourth lateral portion (54), which is comprised between the fifth score line (18), the eighth score line (21), the second score line (12) and the second lateral edge (2*b*) of the cardboard sheet (2); a third reinforcing portion (54*a*) and a fourth reinforcing portion (54*b*), on opposite sides of the fourth lateral portion (54) with respect to the fifth transversal score line (18) and to the eighth transversal score line (21), with the fourth and the seventh score line (17, 20) realised, respectively, in the third reinforcing portion (54*a*) and in the fourth reinforcing portion (54*b*) (see FIG. 10).

The cardboard sheet (2) can be a continuous cardboard sheet in the form of a cardboard strip.

In this case, the cardboard sheet (2) can be sectioned as a function of the dimensions of one or more articles (3) to be boxed.

Alternatively, the cardboard sheet (2) can be in the form of a sectioned cardboard sheet.

Figure 2:
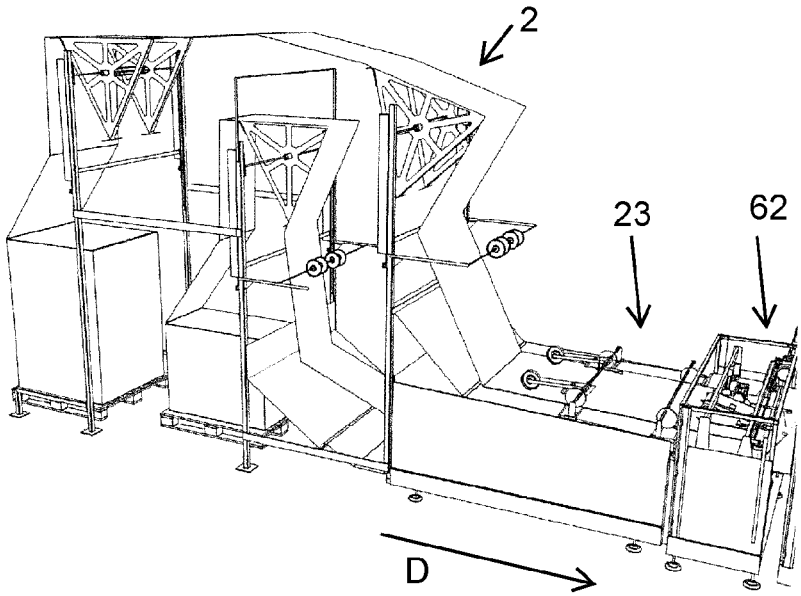
FIGS. 2-13 are perspective views of some parts of the machine of the present invention, during the carrying out of some steps of the method, also object of the present invention.
Figure 3:
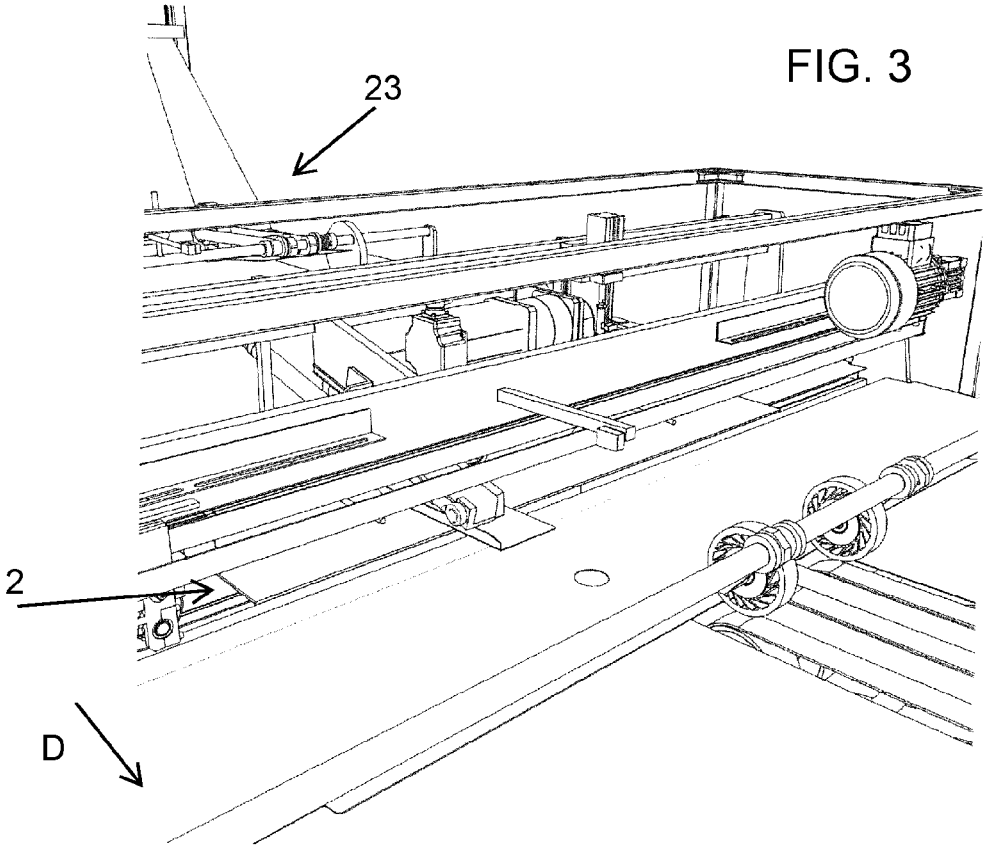
Figure 4:
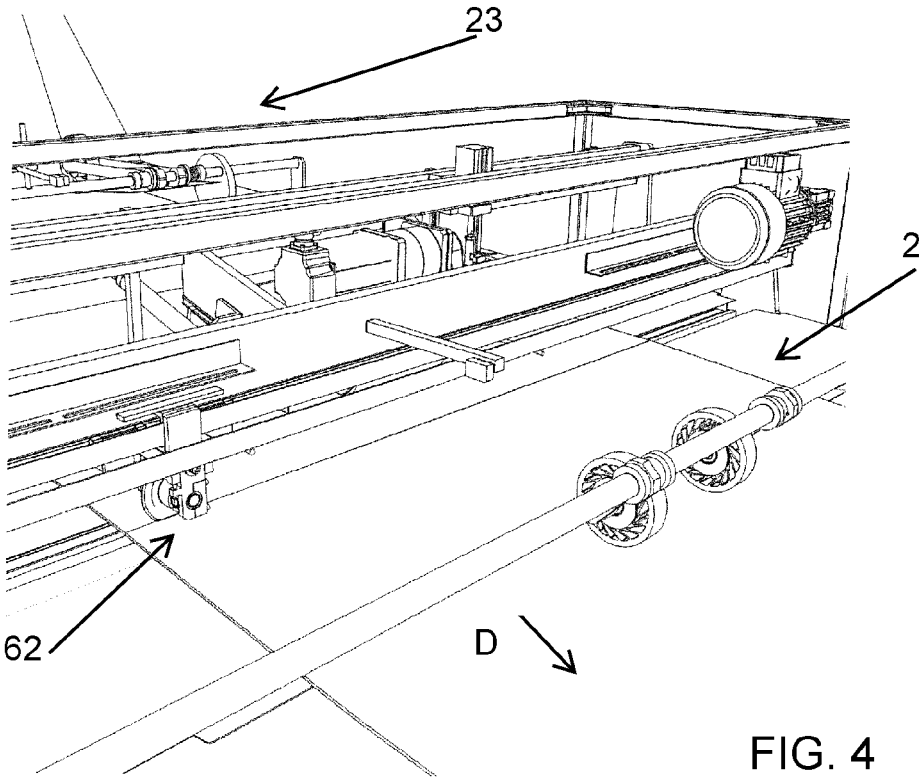

FIGS. 2-4 illustrate the steps of feeding the cardboard sheet (2).

Figure 5:
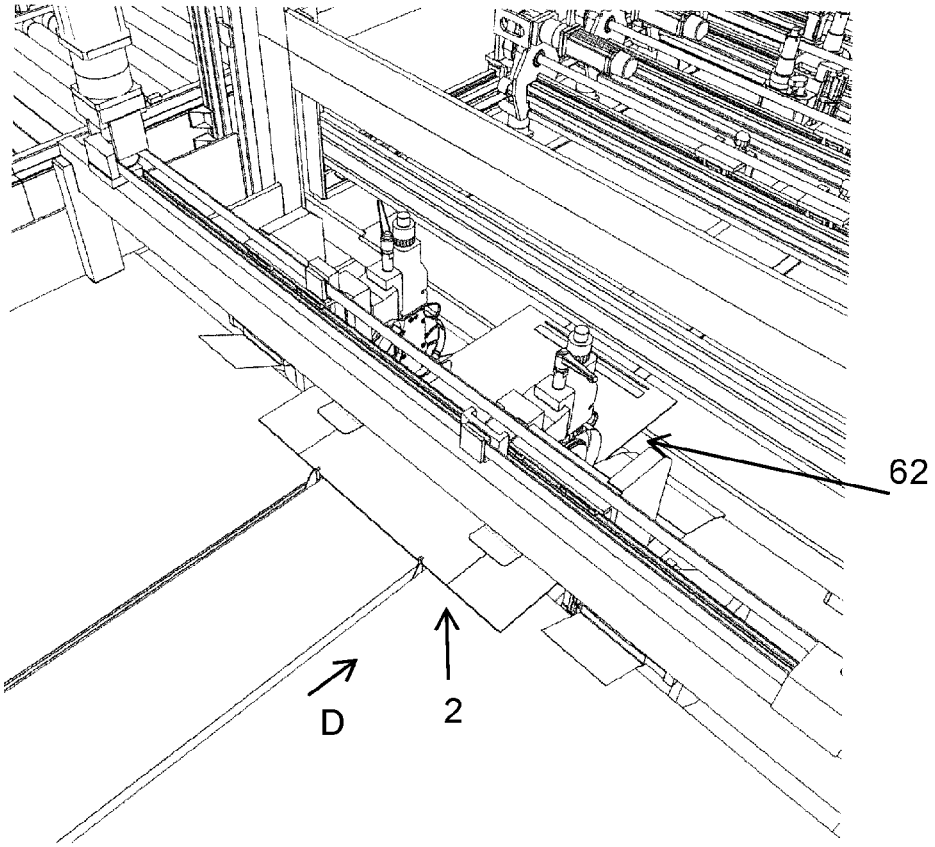

FIG. 2 illustrates the conveyor (23) during the feeding of a cardboard strip, FIGS. 3-5 illustrate the cardboard strip that is sectioned.

The steps of movement of the first support (5) and the second support (8) can be carried out when the cardboard sheet (2) assumes a fixed position or when the cardboard sheet (2) moves along the advancement direction (D).

Figure 11:
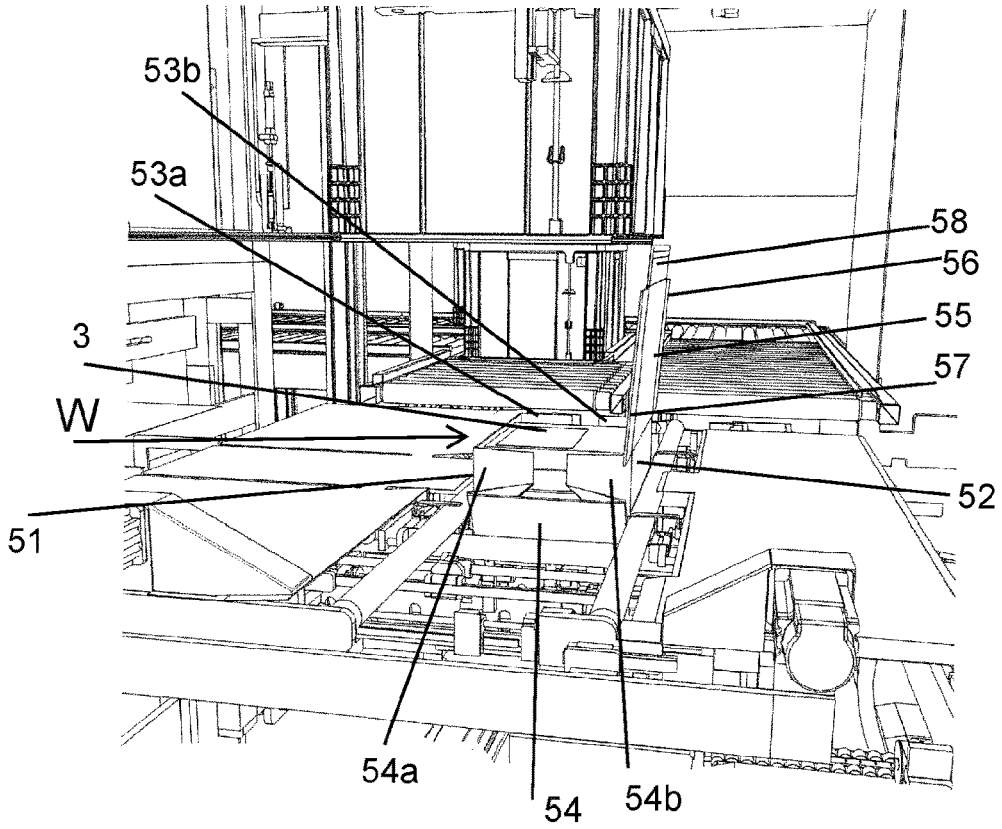
Figure 11A:
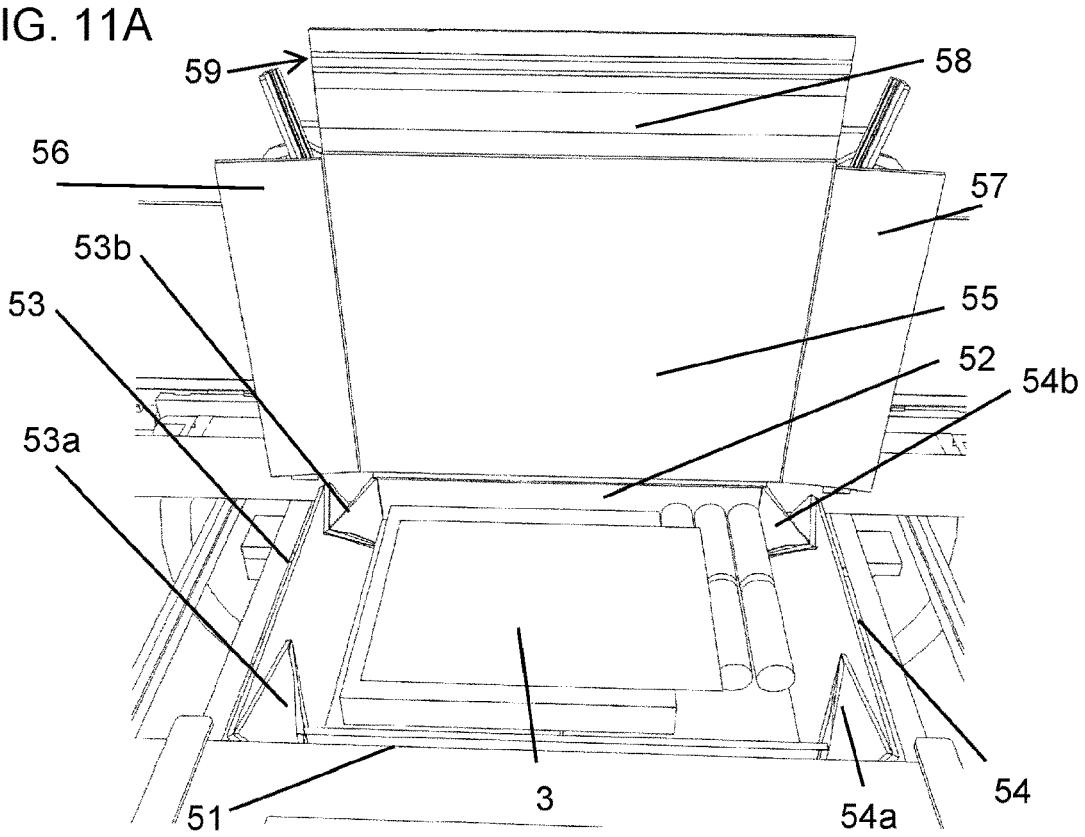
FIG. 11A is a view of detail W of FIG. 11.
Figure 12:
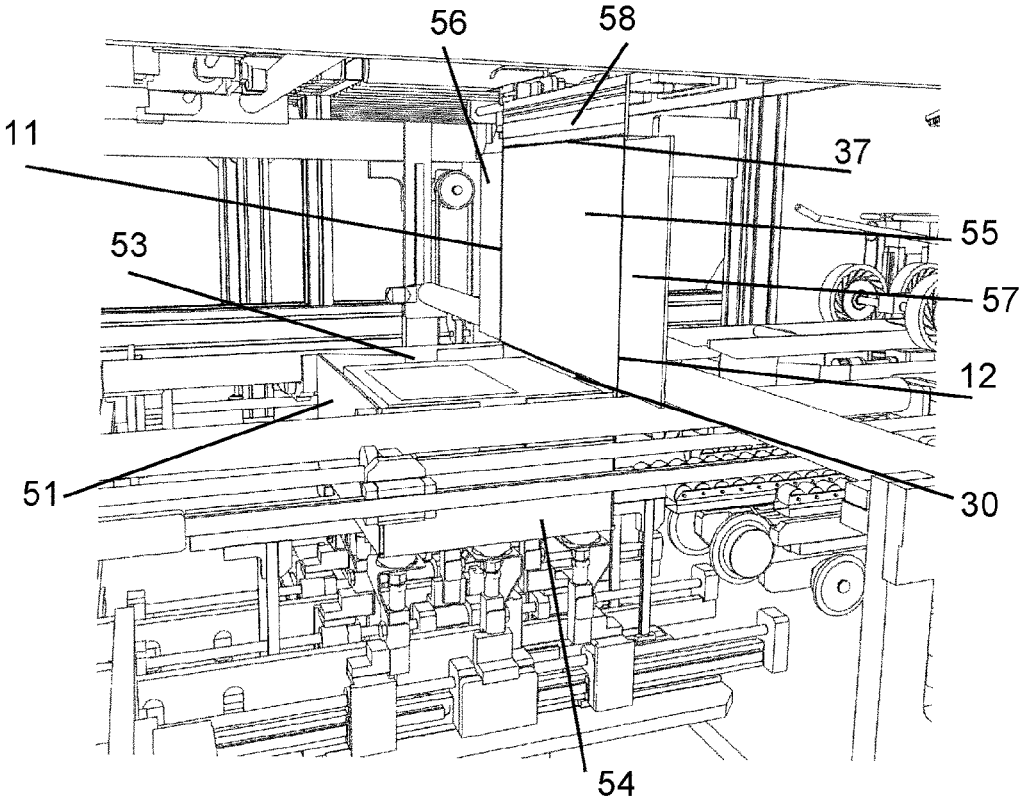
Figure 13:
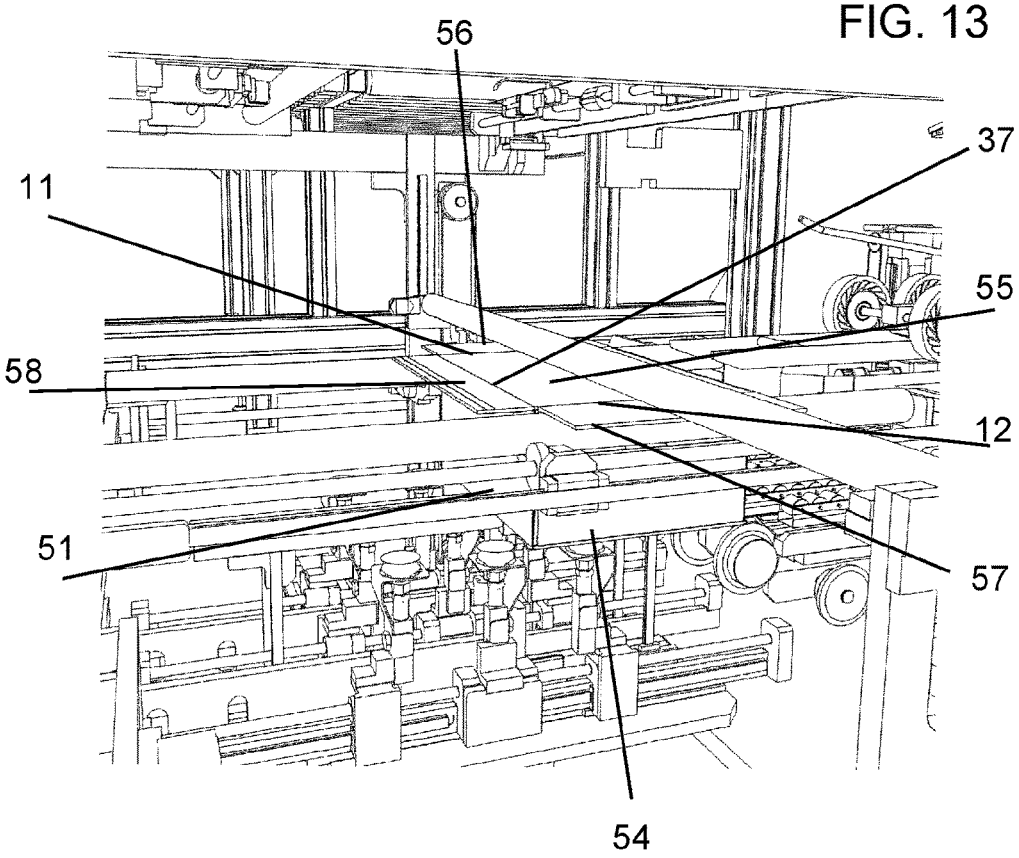

By the dimensions of one or more articles (3) is meant the dimensions of the upper face, the bottom and the lateral faces of the one or more articles (3) (see FIGS. 11 and 11A).

The first support (5) and the second support (8) can be arranged parallel to one another (see FIGS. 6-9).

The first support (5) can be in the form of a bar and the first tool (6) and the second tool (7) can be slidable along the axis of extension of the first support (5) (see FIGS. 6-9).

The second support (8) can be in the form of a bar and the third tool (9) and the fourth tool (10) can be slidable along the axis of extension of the second support (8) (see FIGS. 6-9).

The first direction (D1) and the second direction (D2) can be parallel to one another (see FIGS. 6-9).

In a case where the first support (5) and the second support (8) are arranged on the same plane, the first direction (D1) and the second direction (D2) can coincide with one another (see FIGS. 6-9).

The first score line (11) and the second score line (12) can extend between a third lateral edge (2*c*) of the cardboard sheet (2) and a fourth lateral edge (2*d*) of the cardboard sheet (2), which the third lateral edge (2*c*) and fourth lateral edge (2*d*) of the cardboard sheet (2) are transversal to the advancement direction (D) (see FIG. 10).

The third lateral edge (2*c*) and the fourth lateral edge (2*d*) join the first lateral edge (2*a*) and the second lateral edge (2*b*) of the cardboard sheet (2) to one another (see FIG. 10).

During the step of movement of the first scoring tool (6) and of the second scoring tool (7), the tools can assume an extended position in which they are in contact with the cardboard sheet (2).

In the same way, during the step of movement of the third scoring tool (9) and of the fourth scoring tool (10), these can assume an extended position in which they are in contact with the cardboard sheet (2).

Further, during the step of movement of the first support (5), the first scoring tool (6) and the second scoring tool (7) can assume a retracted position in which they are not in contact with the cardboard sheet (2).

In the same way, during the movement of the second support (8), the third scoring tool (9) and the fourth scoring tool (10) can assume a retracted position in which they are not in contact with the cardboard sheet (2).

Figure 8:
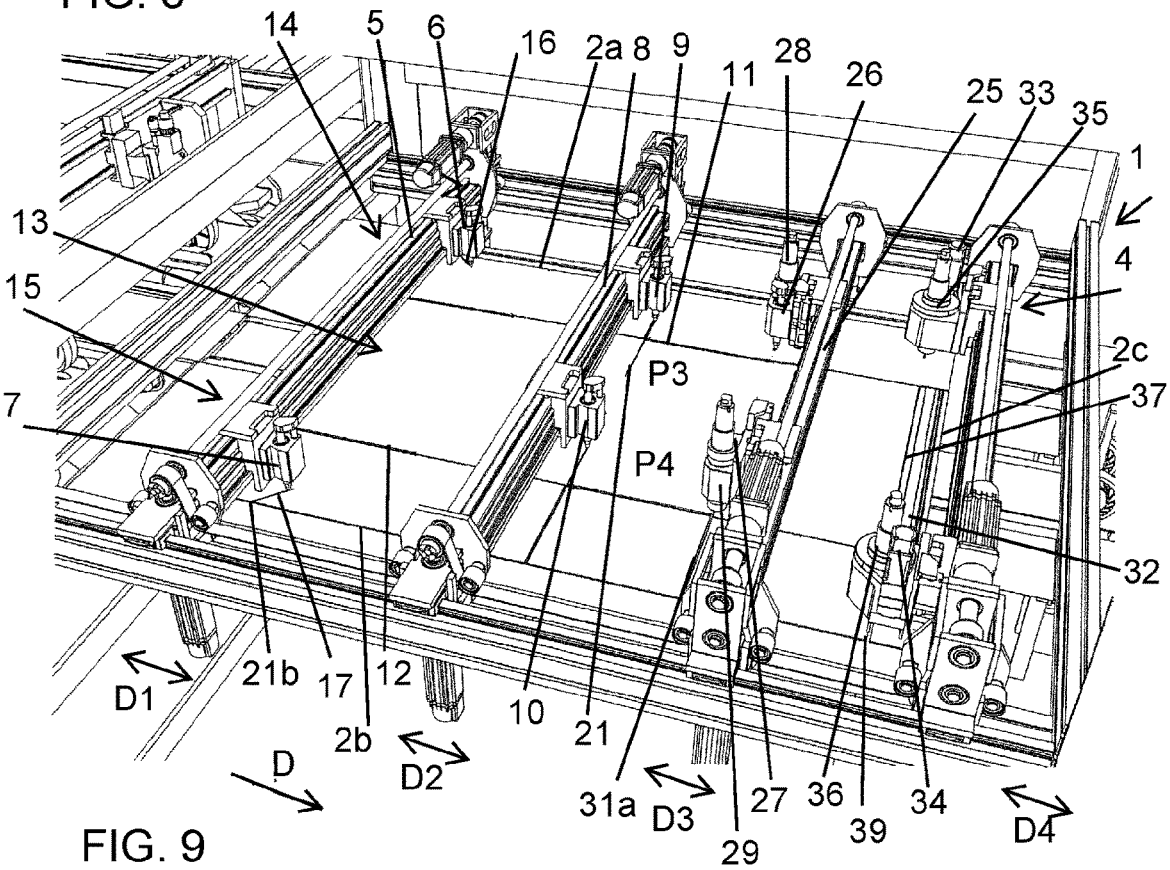

During the step of movement of the first support (6) and, contemporaneously, of the first scoring tool (6) and of the second scoring tool (7), should the first support (5) be moved in the same direction in which the cardboard sheet is fed along the advancement direction (D), the first scoring tool (6) and the second scoring tool (7) can be moved towards one another (see FIG. 8).

Alternatively, the first scoring tool (6) and the second scoring tool (7) can be moved away from one another (not illustrated).

Figure 9:
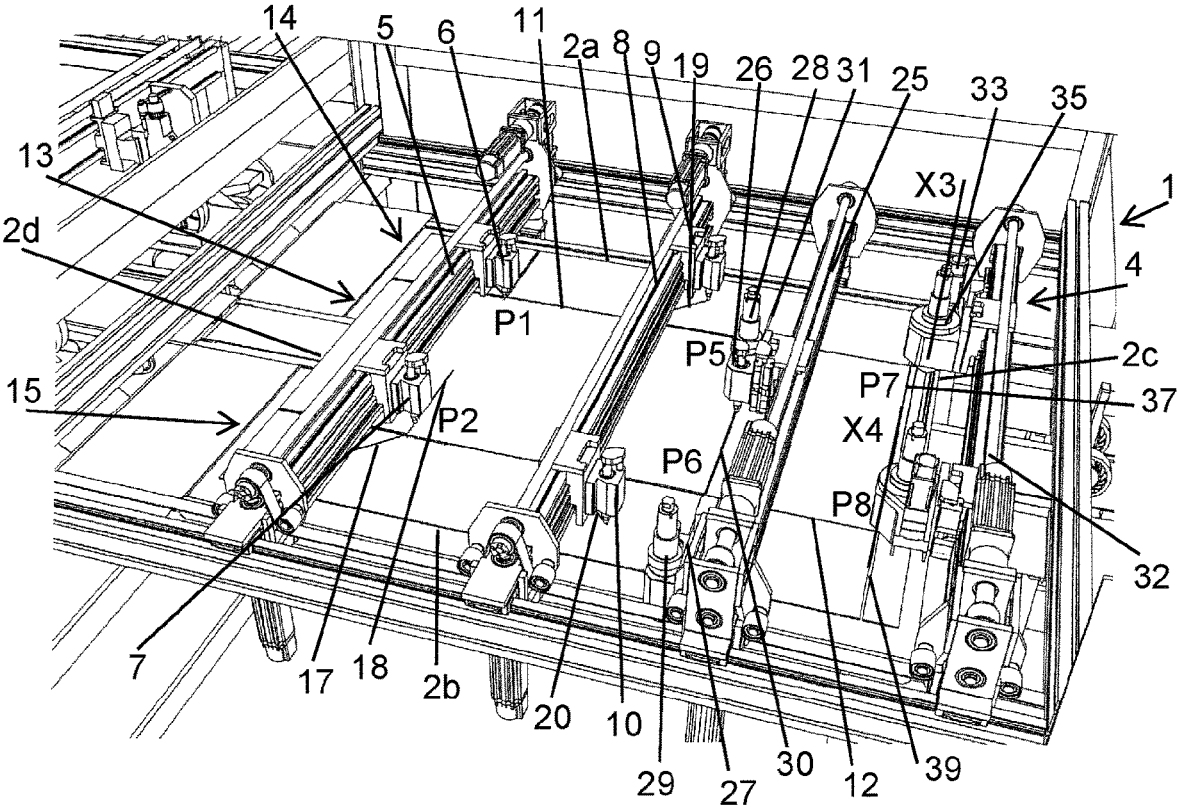

Like considerations can be made for the second support (8), the third scoring tool (9) and the fourth scoring tool (10) (see FIG. 9).

In detail; in FIG. 9, the first support (5) is moved in the same direction in which the cardboard sheet is fed along the advancement direction (D) and the first scoring tool (6) and the second scoring tool (7) are moved towards one another while the second support (8) is moved in the same direction in which the cardboard sheet is fed along the advancement direction (D) and the third scoring tool (9) and the fourth scoring tool (10) are moved away from one another.

The third score line (16) and the fourth score line (17) can be opposite one another (see FIG. 10).

The third score line (16) and the fourth score line (17) can respectively have an inclination of 45° with respect to the advancement direction (D).

The third score line (16) and the fourth score line (17) can be inclined, respectively, towards the first score line (11) and the second score line (12) (see FIG. 10).

The sixth score line (19) and the seventh score line (20) can be opposite one another (see FIG. 10).

The sixth score line (19) and the seventh score line (20) can respectively have an inclination of 45° with respect to the advancement direction (D).

The sixth score line (19) and the seventh score line (20) can be inclined, respectively, towards the first score line (11) and the second score line (12) (see FIG. 10).

The third score line (16) and the sixth score line (19) can be opposite one another.

The fourth score line (17) and the seventh score line (20) can be opposite one another.

The fifth score line (18) and the eighth score line (21) can be perpendicular to the first score line (11) and the second score line (12).

The third score line (16) can extend from a first point (21*a*) of the first lateral edge (2*a*) of the cardboard sheet (2) and the first intersection point (P1) (see FIG. 10).

The fourth score line (17) can extend from a second point (21*b*) of the second lateral edge (2*b*) of the cardboard sheet (2) and the second intersection point (P2) (see FIGS. 8 and 10).

The fifth score line (18) can extend between a third point (23*a*) of the first lateral edge (2*a*) and a fourth point (24*b*) of the second lateral edge (2*b*) of the cardboard sheet (2) (see FIG. 10).

The sixth score line (19) can extend from a fifth point (25*a*) of the first lateral edge (2*a*) of the cardboard sheet (2) and the third intersection point (P3) (see FIG. 10).

The seventh score line (20) can extend from a sixth point (26*b*) of the second lateral edge (2*b*) of the cardboard sheet (2) and the fourth intersection point (P4) (see FIG. 10).

The eighth score line (21) can extend from a seventh point (27*a*) of the first lateral edge (2*b*) and an eighth point (28*b*) of the second lateral edge (2*b*) of the cardboard sheet (2) (see FIG. 10).

The first support (5) can be arranged upstream with respect to the advancement direction (D) an the second support (8) can be arranged downstream with respect to the advancement direction (D) (see FIGS. 6-9).

The scoring means (4) preferably comprise: a third support (25) which is arranged transversally with respect to the advancement direction (D) and which is movable along a third direction (US) parallel to the advancement direction (D) and which bears a fifth scoring tool (26) and a sixth scoring tool (27), which are movable, mutually towards and away from one another, along the third support (25) and which bears a first cutting tool (28) and a second cutting tool (29), which are movable, mutually towards and away from one another, along the third support (25) (see FIGS. 6-9).

Further, on the basis of the dimensional values detected and memorised, the method comprises steps of:

moving the fifth scoring tool (26) and the sixth scoring tool (27) along the third support (25) so that the fifth scoring tool (26) and the sixth scoring tool (27) realise a ninth score line (30) which is transversal to the advancement direction (D), which is downstream of the fifth score line (18) and of the eighth score line (21) along the advancement direction (D): which extends between the first score line (11) and the second score line (12) and which intersects the first score line (11) at a fifth intersection point (P5) and the second score line (12) at a sixth intersection point (P5);

moving the first cutting tool (28) and the second cutting tool (29) along the third support (25) so that the first cutting tool (28) realises, in the first lateral sector (14), a first cut line (31) between the first lateral edge (2*a*) of the cardboard sheet (2) and the first score line (11), which is transversal to the advancement direction (D) and which intersects the first score line (11) at the fifth intersection point (P5) and the second cutting tool (29) realises, in the second lateral sector (15), a second cut line (31*a*) between the second lateral edge (2*b*) of the cardboard sheet (2) and the second score line (12), which is transversal to the advancement direction (D) and which intersects the second score line (11) at the sixth intersection point (P6) (see FIGS. 8-10).

The blank (1), realised by carrying out the steps of the method as described in the foregoing, can advantageously comprise, in the central sector (13), a fifth lateral portion (55) that is hinged to the second lateral portion (52) (see FIG. 10).

During the step of boxing one or more articles (3), and, therefore, the formation of a box (60) from the blank (1), the fifth lateral portion (55) superiorly covers the one or more articles (3) to be boxed, ensuring a closure of the box (60) formed (see FIGS. 11-13 and 11A).

The third direction (D3) and the second direction (D2) can be parallel to one another.

Should the third support (25), the second support (8) and the first support (5) lie on a same plane, the third direction (03), the second direction (D2) and the first direction can coincide with one another.

The third support (25) can be in the shape of a bar, the fifth scoring tool (26) and the sixth scoring tool (27) can be slidable along the axis of extension of the third support (25).

The second support (8) can be arranged interposed between the first support (5) and the third support (25) (see FIGS. 6-9).

The fifth scoring tool (26) and the first cutting tool (28) can be moved contemporaneously along the third support (25) in such a way that the ninth score line (30) and the first cut line (31) are realised, at least partly, contemporaneously (see FIGS. 8 and 9).

The sixth scoring tool (27) and the second cutting tool (29) can be moved contemporaneously along the third support (25) in such a way that the ninth score line (30) and the second cut line (31*a*) are realised, at least partly, contemporaneously (see FIGS. 8 and 9).

The ninth score line (30), the eighth score line (21) and the fifth score line (18) can be parallel to one another.

The ninth score line (30) can be perpendicular to the first score line (11) and the second score line (12).

The scoring means (4) preferably comprise: a fourth support (32) which is arranged transversally to the advancement direction (D) and which is movable along a fourth direction (04) parallel to the advancement direction (D) and which bears a seventh scoring tool (33) and an eighth scoring tool (34), which are movable, mutually towards and away from one another, along the fourth support (32) and which bears a third cutting tool (35) and a fourth cutting tool (36), which are movable, mutually towards and away from one another, along the fourth support (32) (see FIGS. 6-9).

Further, on the basis of the dimensional values detected and memorised, the method comprises steps of:

moving the seventh scoring tool (33) and the eighth scoring tool (34) along the fourth support (32) so that the seventh scoring tool (33) and the eighth scoring tool (34) realise a tenth score line (37) which is transversal to the advancement direction (D), which is downstream of the ninth score line (30) along the advancement direction (D), which extends between the first score line (11) and the second score line (12) and which intersects the first score line (11) at a seventh intersection point (P7) and the second score line (12) at an eighth intersection point (P8);

moving the third cutting tool (35) and the fourth cutting tool (36) along the fourth support (32) so that the third cutting tool (35) realises, in the first lateral sector (14), a third cut line (38) between the first lateral edge (2*a*) of the cardboard sheet (2) and the first score line (1*i*), which is transversal to the advancement direction (D) and which intersects the first score line (11) at the seventh intersection point (P7) and the fourth cutting tool (36) realises, in the second lateral sector (15), a fourth cut line (39) between the second lateral edge (2*b*) of the cardboard sheet (2) and the second score line (12), which is transversal to the advancement direction (D) and which intersects the second score line (11) at the eighth intersection point (P8).

The blank (1) realised with the steps of the above-described method advantageously comprises, in the first lateral sector (14), a first flap (56) which is hinged to the fifth lateral portion (55) and, in the second lateral sector (15), a second flap (57) which is hinged to the fifth lateral portion (55): the first flap (55) and the second flap (57) are arranged opposite with respect to the fifth lateral portion (55) (see FIG. 10).

During the step of boxing one or more articles (3), and, therefore, the formation of a box (60) from the blank (1), the first flap (56) and the second flap (57) are overlapping, respectively, the third lateral portion (53) and the fourth lateral portion (54) to give the box a greater rigidity (see FIGS. 11-13 and 11A).

The fourth direction (D4) and the third direction (03) can be parallel to one another.

Should the fourth support (32), the third support (25), the second support (8) and the first support (5) lie on a same plane, the fourth direction (D4), the third direction (D3), the second direction (D2) and the first direction can coincide with one another.

The first support (5), the second support (8), the third support (25) and the fourth support (32) can be moved contemporaneously.

The fourth support (32) can be in the form of a bar and the seventh scoring tool (33) and the eighth scoring tool (34) can be slidable along the axis of extension of the fourth support (32) (see FIGS. 6-10).

The tenth score line (37), the eighth score line (21) and the fifth score line (18) can be parallel to one another.

The seventh scoring tool (33) and the third cutting tool (35) can be moved contemporaneously along the fourth support (32) in such a way that the tenth score line (37) and the third cut line (38) are realised, at least partly, contemporaneously (see FIGS. 9 and 10).

The eighth scoring tool (34) and the fourth cutting tool (36) can be moved contemporaneously along the fourth support (32) in such a way that the tenth score line (37) and the fourth cut line (39) are realised, at least partly, contemporaneously (see FIGS. 9 and 10).

The third cutting tool (35) and the fourth cutting tool (36) are preferably rotatable with respect to a relative rotation axis (X3, X4) which is transversal to the fourth support (32).

Figure 14:
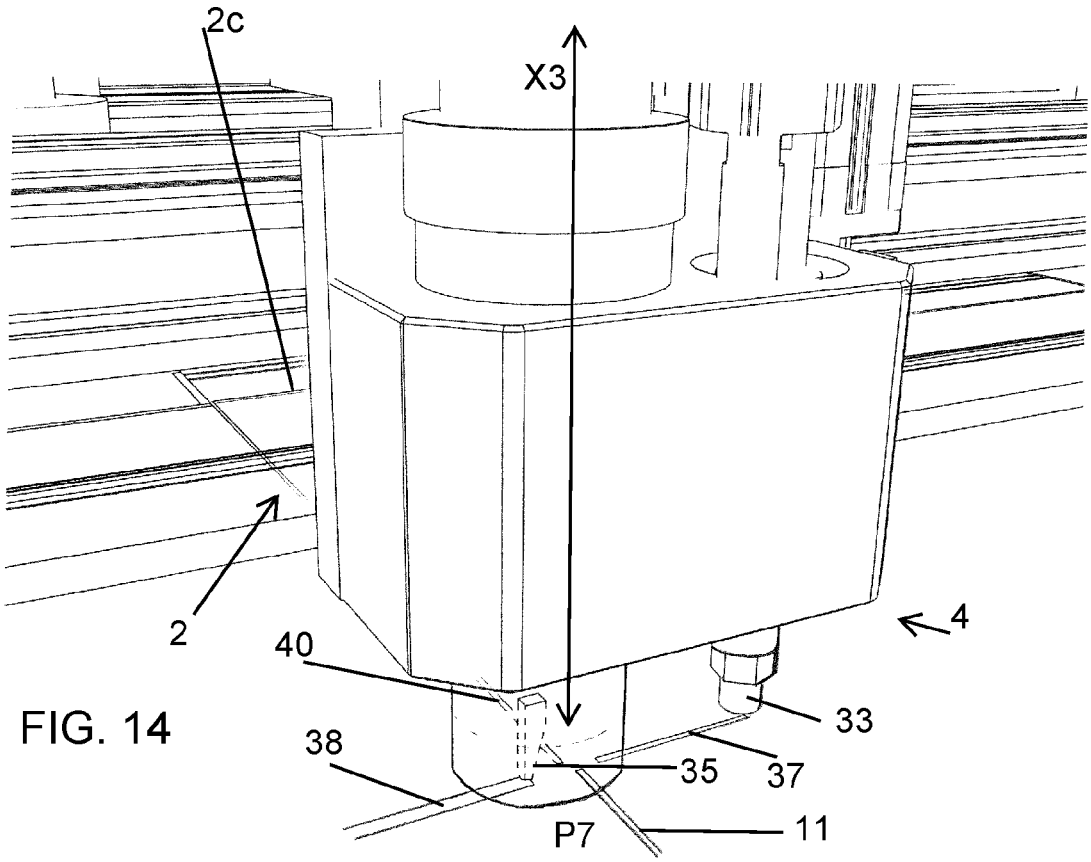
FIGS. 14-16 are perspective views of detail K of FIG. 10, during different steps of the method.
Figure 15:
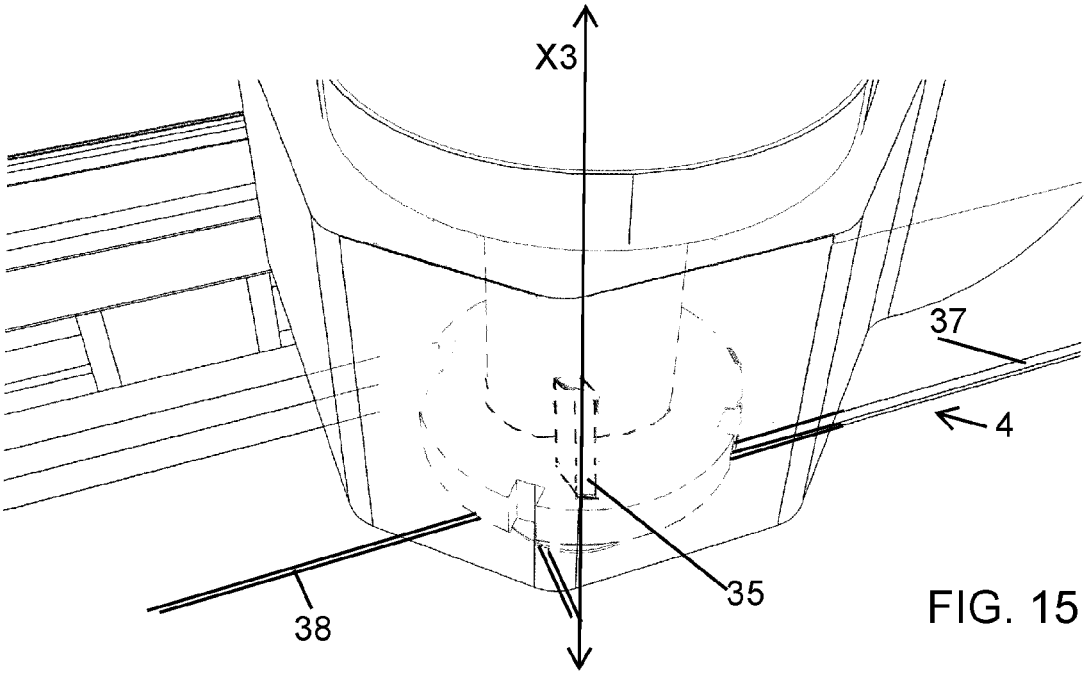
Figure 16:
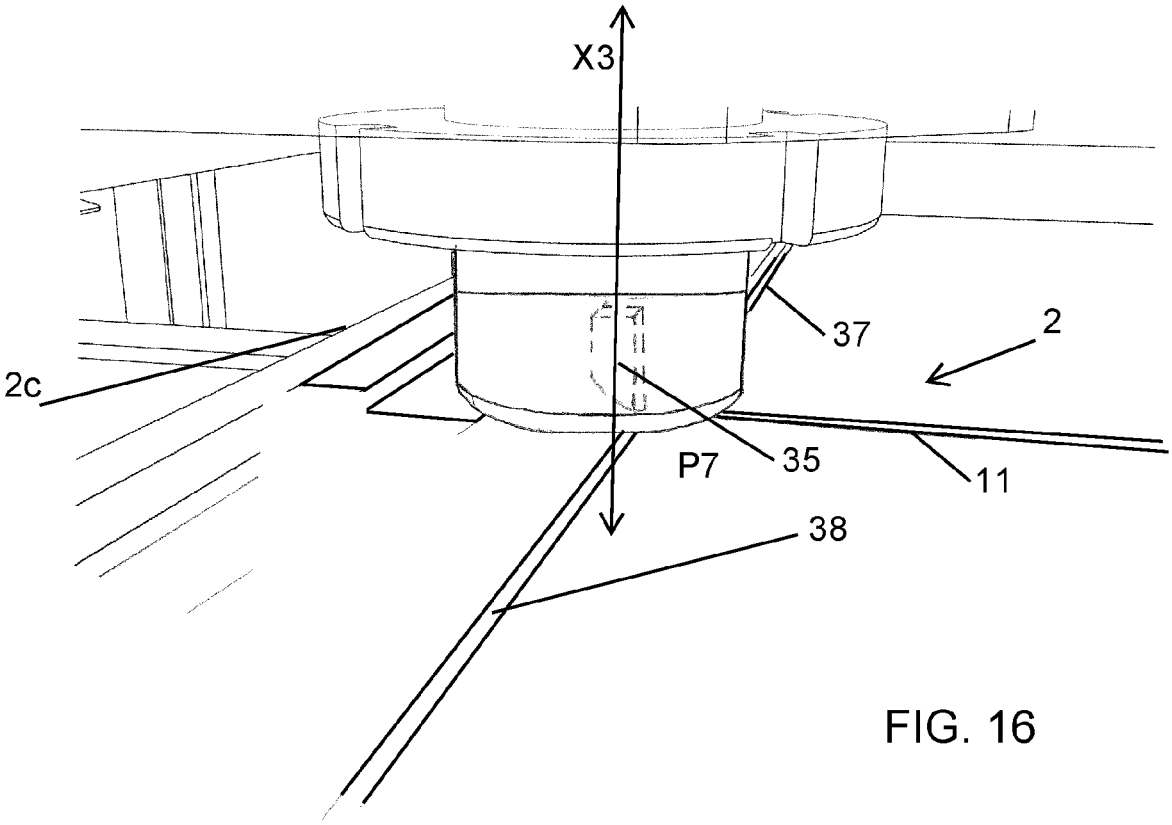

Further, on the basis of the dimensional values detected and memorised, the method comprises steps of:

rotating the third cutting tool (35) about the relative rotation axis (X3) so as to be orientated to realise a fifth cut line (40) between the seventh intersection point (P7) and a third lateral edge (2*c*) of the cardboard sheet (2) which is transversal to the advancement direction (D), during the movement of the fourth support (32), relative to the cardboard sheet (2), along the fourth direction (D4), with a consequent removal of the portion of cardboard sheet (2) comprised between the third cut line (38) and the fifth cut line (40);

rotating the fourth cutting tool (36) about the relative rotation axis (X4) so as to be orientated to realise a sixth cut line (41) between the eighth intersection point (P8) and the third lateral edge (2*c*) of the cardboard sheet (2) which is transversal to the advancement direction (D), during the movement of the fourth support (32), relative to the cardboard sheet (2), along the fourth direction (04), with a consequent removal of the portion of cardboard sheet (2) comprised between the fourth cut line (39) and the sixth cut line (41) (see FIGS. 14-16).

The blank (1), realised by carrying out the steps of the method as described in the foregoing, can advantageously comprise a third flap (58) which is hinged to the fifth lateral portion (55) and on which can be arranged fixing means (59) for the closing of the box (60) (see FIG. 10).

The fifth cut line (40) and the sixth cut line (41) can be arranged perpendicularly, respectively, at the third cut line (38) and the fourth cut line (39) (see FIG. 10).

The third lateral edge (2*c*) of the cardboard sheet (2) can be arranged in proximity of the seventh intersection point (P7) and of the eighth intersection 20, point (P8).

In detail, FIG. 14 illustrates the step in which the third cutting tool (35) is making the third cut line (38) and the seventh scoring tool (33) is making, partly, the tenth score line (37).

FIG. 15 illustrates the step of rotation of the third cutting tool (35) about the relative rotation axis (X3) and FIG. 16 illustrates the step in which the third cutting tool (35) is making, partly, the fifth out line (40).

With reference to FIG. 1, in the following a machine (61) is described for actuating the method for realising a blank (1) for boxing one or more articles (3) from a cardboard sheet (2) for packaging, according to any one of the embodiments described in the foregoing, comprising:

a conveyor (23) for feeding a cardboard sheet (2) for packaging according to an advancement direction (D);

detecting means (24) for detecting dimensions of one or more articles (3) to be boxed;

scoring means (4) comprising:

a first support (5) which is arranged transversally to the advancement direction (D) and which is movable along a first direction (D1) parallel to the advancement direction (D) and which bears a first scoring tool (6) and a second scoring tool (7), which are movable, mutually towards and away from one another, along the first support (5):

a second support (8) which is arranged transversally to the advancement direction (D) and which is movable along a second direction (02) parallel to the advancement direction (D) and which bears a third scoring tool (9) and a fourth scoring tool (10), which are movable, mutually towards and away from one another, along the second support (8);

a control unit (22) configured to memorise the dimensions of one or more articles (3) to be boxed and for moving the scoring means (4) on the basis of the dimensional values detected and memorised.

The above considerations in relation to the method of the present invention are also valid for the machine (61), also an object of the present invention.

In the same way, as regards the machine (61), the same advantages pertain as described in the foregoing in relation to the method for realising a blank (1) for boxing one or more articles (3) from a cardboard sheet (2) for packaging.

The first support (5) can be arranged upstream with respect to the advancement direction (0) and the second support (8) can be arranged downstream with respect to the advancement direction (D).

The scoring means (4) can comprise: a third support (25) which is arranged transversally with respect to the advancement direction (D) and which is movable along a third direction (03) parallel to the advancement direction (D) and which bears a fifth scoring tool (26) and a sixth scoring tool (27), which are movable, mutually towards and away from one another, along the third support (25) and which bears a first cutting tool (28) and a second cutting tool (29), which are movable, mutually towards and away from one another, along the third support (25).

Further, the scoring means (4) can comprise: a fourth support (32) which is arranged transversally to the advancement direction (D) and which is movable along a fourth direction (04) parallel to the advancement direction (D) and which bears a seventh scoring tool (33) and an eighth scoring tool (34), which are movable, mutually towards and away from one another, along the fourth support (32) and which bears a third cutting tool (35) and a fourth cutting tool (36), which are movable, mutually towards and away from one another, along the fourth support (32).

The third cutting tool (35) and the fourth cutting tool (36) can be rotatable with respect to a relative rotation axis (X3, X4) which is transversal to the fourth support (32).

The machine (61) can comprise cutting means (62) arranged for realising parallel cuts or transversal cuts to the advancement direction (D) so as to select the cardboard sheet (2) (see FIGS. 3 and 4).

These cutting means (62) can be arranged upstream with respect to the scoring means (4) along the advancement direction (D) (see FIGS. 1, 4 and 5).

Figure 6:
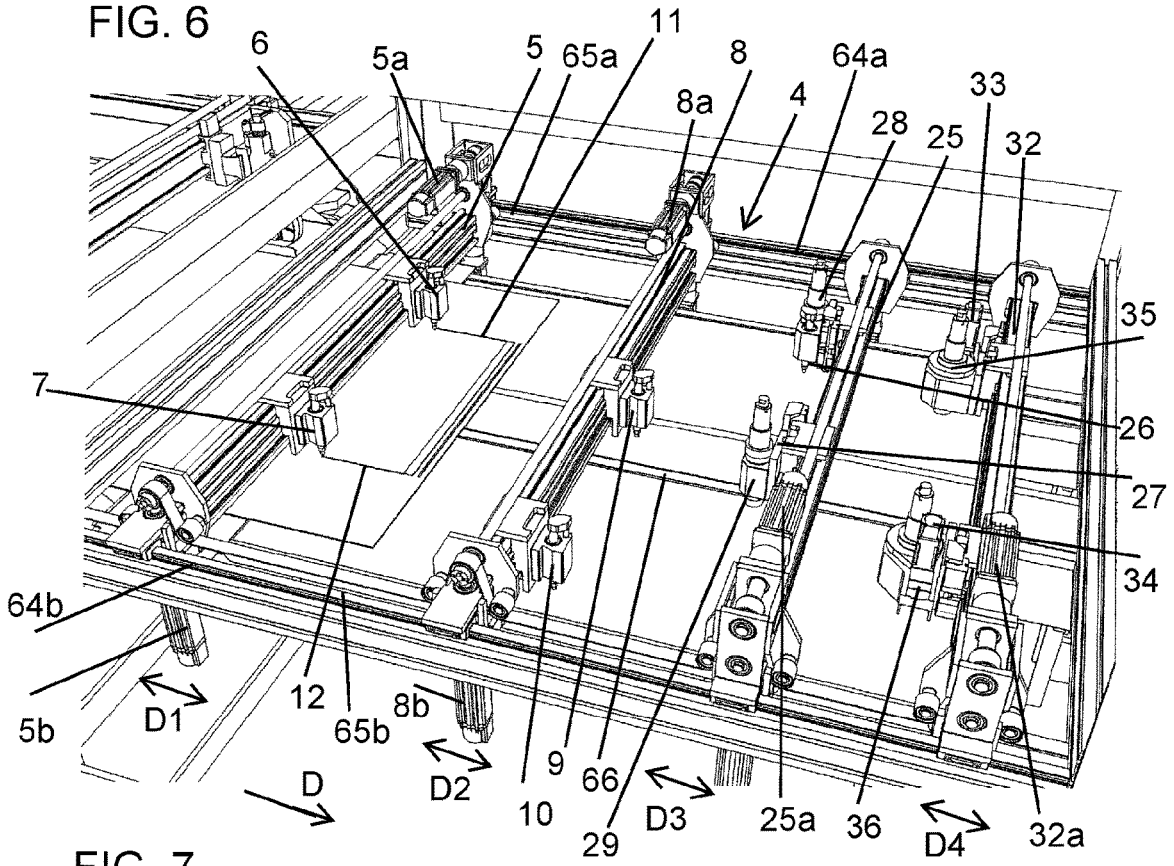
Figure 7:
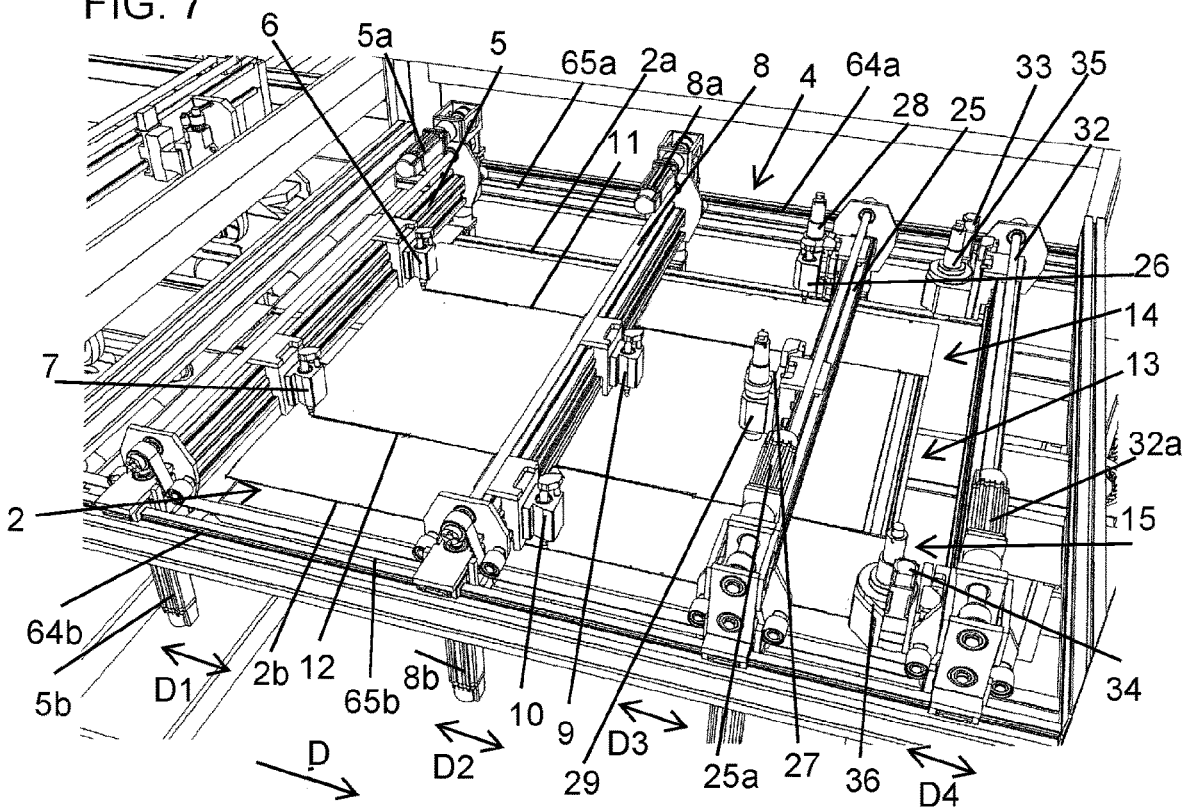

The machine (61) can further comprise a frame (63) which in turn comprises, a pair of longitudinal members (64*a*, 64*b*) which extend parallel to the advancement direction (D) with each provided with a guide (65*a*, 65*b*) along which the first support (5) and the second support (3) can slide (see FIGS. 6 and 7).

The first support (5) and the second support (8) can be moved by a relative motor (Sa, 8*a*) (see FIGS. 6 and 7).

In turn: the first scoring tool (6) and the second scoring tool (7) can be moved by a relative motor (5*b*) and the third scoring tool (9) and the fourth scoring tool (10) can be moved by a relative motor (8*b*) (see FIGS. 6 and 7).

With reference to FIGS. 6-10, the machine (61) can comprise a support plane (66) for restingly receiving the cardboard sheet (2) during the movement of the scoring means (4).

The third support (25) and the fourth support (32) can be moved by a relative motor (25*a*, 32*a*) (see FIGS. 6 and 7).

The third support (25) and the fourth support (32) can slide along the guides (65*a*, 65*b*) (see FIGS. 6 and 7).

In turn: the fifth scoring tool (26) the sixth scoring tool (27), the first cutting tool (28) and the second cutting tool (29) can be moved by a relative motor (not illustrated) and the seventh scoring tool (33), the eighth scoring tool (34), the third cutting tool (35) and the fourth cutting tool (36) can be moved by a relative motor (not illustrated).

The rotation of the third cutting tool (35) about the relative rotation axis (X3) and of the fourth cutting tool (36) about the relative rotation axis (X4) can be activated by a motor.

The first cutting tool (28), the second cutting tool (29), the third cutting tool (35) and the fourth cutting tool (36) can be in the shape of a blade.

Once the blank (1) has been realised, the one or more articles (3) are boxed with the box (60) obtained in the following steps:

arranging the one or more articles (3) on the main portion (50);

folding, towards the one or more articles (3), the first lateral portion (51) with respect to the fifth score line (18), the second lateral portion (52) with respect to the eighth score line (21), the third lateral portion (53) with respect to the first score line (11) and the fourth lateral portion (54) with respect to a second score line (12) and, at the same time, folding the first reinforcing portion (53*a*) on itself with respect to the third score line (16), the second reinforcing portion (53*b*) with respect to the sixth score line (19), the third reinforcing portion (54*a*) with respect to the fourth score line (17) and the fourth reinforcing portion (54*b*) with respect to the seventh score line (20) in such a way that they are arranged facing towards the one or more articles (3);

folding, towards the one or more articles (3), the fifth lateral portion (55) with respect to the ninth score line (30):

folding the first flap (56) with respect to the first score line (11) and the second flap (57) with respect to the second score line (12) so that they are arranged overlapped, respectively, on the third lateral portion (53) and the fourth lateral portion (54);

folding the third flap (58) with respect to the tenth score line (37) in such a way that it is arranged overlapped on the first lateral portion (51) (see FIGS. 11-13 and 11A).

The invention claimed is:

1. A method for realizing a blank for boxing one or more articles from a cardboard sheet for packaging, comprising following steps:

arranging a conveyor for feeding a cardboard sheet for packaging according to an advancement direction (D);

detecting dimensions of one or more articles to be boxed with a detector;

arranging scoring means comprising:

a first support which is arranged transversally to the advancement direction (D) and which is movable along a first direction (D1) parallel to the advancement direction (D) and which bears a first scoring tool and a second scoring tool, which are movable, mutually towards and away from one another, along the first support;

a second support which is arranged transversally to the advancement direction (D) and which is movable along a second direction (D2) parallel to the advancement direction (D) and which bears a third scoring tool and a fourth scoring tool, which are movable, mutually towards and away from one another, along the second support;

memorizing, using said detector, the dimensions of one or more articles to be boxed;

on the basis of the dimensional values of the dimensions detected and memorized, the method comprises steps of:

adjusting the distance, along the first support, between the first scoring tool and the second scoring tool so that, during the advancement of the cardboard sheet along the advancement direction (D), the first scoring tool realizes a first score line parallel to the advancement direction (D) and the second scoring tool realizes a second score line which is parallel to the first score line, so as to define, on the cardboard sheet:

a central sector comprised between the first score line and the second score line; a first lateral sector comprised between the first score line and a first lateral edge of the cardboard sheet, which first lateral edge is parallel to the advancement direction; a second lateral sector comprised between the second score line and a second lateral edge of the cardboard sheet, which second lateral edge is parallel to the first lateral edge;

moving the first support, relative to the cardboard sheet, along the first direction and, contemporaneously, moving the first scoring tool and the second scoring tool along the first support so that:

the first scoring tool realizes, in the first lateral sector, a third score line between the first lateral edge of the cardboard sheet and the first score line, which third score line is oblique with respect to the advancement direction (D) and intersects the first score line in a first intersection point;

the second scoring tool realizes, in the second lateral sector, a fourth score line between the second lateral edge of the cardboard sheet and the second score line, which fourth score line is oblique with respect to the advancement direction (D) and intersects the second score line in a second intersection point;

moving the first scoring tool and the second scoring tool along the first support so that the first scoring tool and the second scoring tool realize a fifth score line which is transversal to the advancement direction (D) and which extends between the first lateral edge of the cardboard sheet and the second lateral edge of the cardboard sheet and which intersects the first score line at the first intersection point and the second score line at the second intersection point;

moving the second support, relative to the cardboard sheet, along the second direction (D2) and, contemporaneously, moving the third scoring tool and the fourth scoring tool along the second support so that:

the third scoring tool realizes, in the first lateral sector, a sixth score line between the first lateral edge of the cardboard sheet and the first score line, which sixth score line is oblique with respect to the advancement direction (D) and intersects the first score line in a third intersection point;

the fourth scoring tool realizes, in the second lateral sector, a seventh score line between the second lateral edge of the cardboard sheet and the second score line, which seventh score line is oblique with respect to the advancement direction (D) and intersects the second score line in a fourth intersection point;

moving the third scoring tool and the fourth scoring tool along the second support so that the third scoring tool and the fourth scoring tool realize an eighth score line which is transversal to the advancement direction (D) and which extends between the first lateral edge of the cardboard sheet and the second lateral edge of the cardboard sheet and which intersects the first score line at the third intersection point and the second score line at the fourth intersection point.

2. The method of claim 1, wherein:

the first support is arranged upstream with respect to the advancement direction (D);

the second support is arranged downstream with respect to the advancement direction (D).

3. The method of claim 1, wherein:

the scoring means comprise: a third support which is arranged transversally to the advancement direction (D) and which is movable along a third direction (D3) parallel to the advancement direction (D) and which bears a fifth scoring tool and a sixth scoring tool, which are movable, mutually towards and away from one another, along the third support and which bears a first cutting tool and a second cutting tool, which are movable, mutually towards and away from one another, along the third support;

on the basis of the dimensional values detected and memorized, the method comprises steps of:

moving the fifth scoring tool and the sixth scoring tool along the third support so that the fifth scoring tool and the sixth scoring tool realize a ninth score line which is transversal to the advancement direction (D), which is downstream of the fifth score line and of the eighth score line along the advancement direction (D), which extends between the first score line and the second score line and which intersects the first score line at a fifth intersection point and the second score line at a sixth intersection point;

moving the first cutting tool and the second cutting tool along the third support so that the first cutting tool realizes, in the first lateral sector, a first cut line between the first lateral edge of the cardboard sheet and the first score line, which is transversal to the advancement direction (D) and which intersects the first score line at the fifth intersection point and the second cutting tool realizes, in the second lateral sector, a second cut line between the second lateral edge of the cardboard sheet and the second score line, which is transversal to the advancement direction (D) and which intersects the second score line at the sixth intersection point.

4. The method of claim 3, wherein:

the scoring means comprise: a fourth support which is arranged transversally with respect to the advancement direction (D) and which is movable along a fourth direction (D4) parallel to the advancement direction (D) and which bears a seventh scoring tool and an eighth scoring tool, which are movable, mutually towards and away from one another, along the fourth support and which bears a third cutting tool and a fourth cutting tool, which are movable, mutually towards and away from one another, along the fourth support;

on the basis of the dimensional values detected and memorized, the method comprises steps of:

moving the seventh scoring tool and the eighth scoring tool along the fourth support so that the seventh scoring tool and the eighth scoring tool realize a tenth score line which is transversal to the advancement direction (D), which is downstream of the ninth score line along the advancement direction (D), which extends between the first score line and the second score line and which intersects the first score line at a seventh intersection point and the second score line at an eighth intersection point;

moving the third cutting tool and the fourth cutting tool along the fourth support so that the third cutting tool realizes, in the first lateral sector, a third cut line between the first lateral edge of the cardboard sheet and the first score line, which is transversal to the advancement direction (D) and which intersects the first score line at the seventh intersection point and the fourth cutting tool realizes, in the second lateral sector, a fourth cut line between the second lateral edge (2*b*) of the cardboard sheet and the second score line, which is transversal to the advancement direction (D) and which intersects the second score line at the eighth intersection point.

5. The method of claim 4, wherein:

the third cutting tool and the fourth cutting tool are rotatable with respect to a relative rotation axis (X3, X4) which is transversal to the fourth support;

on the basis of the dimensional values detected and memorized, the method comprises steps of:

rotating the third cutting tool about the relative rotation axis (X3) so as to be orientated to realize a fifth cut line between the seventh intersection point and a third lateral edge of the cardboard sheet which is transversal to the advancement direction (D), during the movement of the fourth support, relative to the cardboard sheet, along the fourth direction (D4), with a consequent removal of the portion of cardboard sheet comprised between the third cut line and the fifth cut line;

rotating the fourth cutting tool about the relative rotation axis (X4) so as to be orientated to realize a sixth cut line between the eighth intersection point and the third lateral edge of the cardboard sheet which is transversal to the advancement direction (D), during the movement of the fourth support, relative to the cardboard sheet, along the fourth direction (D4), with a consequent removal of the portion of cardboard sheet comprised between the fourth cut line and the sixth cut line.

6. A machine for actuating a method for realizing a blank for boxing one or more articles from a cardboard sheet for packaging, of claim 1, comprising:

a conveyor for feeding a cardboard sheet for packaging according to an advancement direction (D);

a detector configured to detect dimensions of one or more articles to be boxed;

scoring means comprising:

a first support which is arranged transversally to the advancement direction (D) and which is movable along a first direction (D1) parallel to the advancement direction (D) and which bears a first scoring tool and a second scoring tool, which are movable, mutually towards and away from one another, along the first support;

a second support which is arranged transversally to the advancement direction (D) and which is movable along a second direction (D2) parallel to the advancement direction (D) and which bears a third scoring tool and a fourth scoring tool, which are movable, mutually towards and away from one another, along the second support;

a control unit configured to memorize the dimensions of one or more articles to be boxed and for moving the scoring means on the basis of the dimensional values detected and memorized.

7. The machine of claim 6, wherein:

the first support is arranged upstream with respect to the advancement direction (D);

the second support is arranged downstream with respect to the advancement direction (D).

8. The machine of claim 6, wherein:

the scoring means comprise: a third support which is arranged transversally with respect to the advancement direction (D) and which is movable along a third direction (D3) parallel to the advancement direction (D) and which bears a fifth scoring tool and a sixth scoring tool, which are movable, mutually towards and away from one another, along the third support and which bears a first cutting tool and a second cutting tool, which are movable, mutually towards and away from one another, along the third support.

9. The machine of claim 8, wherein:

the scoring means comprise: a fourth support which is arranged transversally to the advancement direction (D) and which is movable along a fourth direction (D4) parallel to the advancement direction (D) and which bears a seventh scoring tool and an eighth scoring tool, which are movable, mutually towards and away from one another, along the fourth support and which bears a third cutting tool and a fourth cutting tool, which are movable, mutually towards and away from one another, along the fourth support.

10. The machine of claim 9, wherein:

the third cutting tool and the fourth cutting tool are rotatable with respect to a relative rotation axis (X3, X4) which is transversal to the fourth support.

* * * * *